US007596897B2

(12) United States Patent
Lee

(10) Patent No.: US 7,596,897 B2
(45) Date of Patent: Oct. 6, 2009

(54) BANNER DISPLAYING DEVICE

(75) Inventor: Chia-En Lee, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/141,206

(22) Filed: Jun. 18, 2008

(65) Prior Publication Data

US 2009/0158627 A1 Jun. 25, 2009

(30) Foreign Application Priority Data

Dec. 20, 2007 (CN) ..... 2007 1 0203290

(51) Int. Cl.
*G09F 11/18* (2006.01)

(52) U.S. Cl. ..... 40/514; 40/515

(58) Field of Classification Search ..... 40/493, 40/494, 499, 500, 514–516, 529, 377, 383; 206/408, 389, 524, 525
See application file for complete search history.

(56) References Cited

U.S. PATENT DOCUMENTS

| | | | | |
|---|---|---|---|---|
| 827,539 | A * | 7/1906 | Kohymeyer | 206/214 |
| 1,576,412 | A * | 3/1926 | Cronk | 40/516 |
| 5,921,394 | A * | 7/1999 | Shroff | 206/534 |
| 7,222,817 | B2 * | 5/2007 | Stringer | 242/588.3 |

* cited by examiner

*Primary Examiner*—Cassandra Davis
(74) *Attorney, Agent, or Firm*—Steven M. Reiss

(57) ABSTRACT

A banner displaying device (100) includes a receiving member (10), a rotating member (30) and a plurality of banners (50). The receiving member defines a cavity (115) and an opening (117) communicating with the cavity therein. The rotating member is rotatably mounted on the receiving member, and includes an axle (31) and a plurality of partitions (32) mounted on the axle and received in the cavity. The banners and the partitions are alternately mounted on the axle.

11 Claims, 3 Drawing Sheets

BANNER DISPLAYING DEVICE

BACKGROUND OF THE INVENTION

1. Field of the Invention

The present invention generally relates to banner displaying devices, particularly to a banner displaying device which requires changing the banners being displayed thereon.

2. Description of Related Art

Banner displaying devices, such as banner boards, are widely used in factories to display standard operating procedures (SOPs). Generally, the SOPs are printed onto banners made of paper or fabric, and the banners are attached to the banner displaying devices.

Understandably, the SOP often needs to be changed corresponding to different manufacturing procedures. In use of the typical banner displaying devices, such as banner boards, banners displaying SOP are directly attached to the banner boards to display. When changing the SOP, former banners are removed and new banners are attached to the banner boards. However, in a factory, there are usually a great number of banner displaying devices configured for displaying SOP and requiring to change the banners attached thereon. Replacing the former banners with the new banners is time consuming. Additionally, when the former banners are removed from typical banner displaying devices, they are prone to be tear up and cannot be re-used, and additional expense is required to fabricate new banners.

Therefore, a new banner displaying device is desired in order to overcome the above-described shortcomings.

BRIEF DESCRIPTION OF THE DRAWINGS

Many aspects of the new banner displaying device can be better understood with reference to the following drawings. The components in the drawings are not necessarily drawn to scale, the emphasis instead being placed upon clearly illustrating the principles of the new banner displaying device. Moreover, in the drawings, like reference numerals designate corresponding parts throughout the several views.

DETAILED DESCRIPTION OF THE INVENTION

Figure 1:
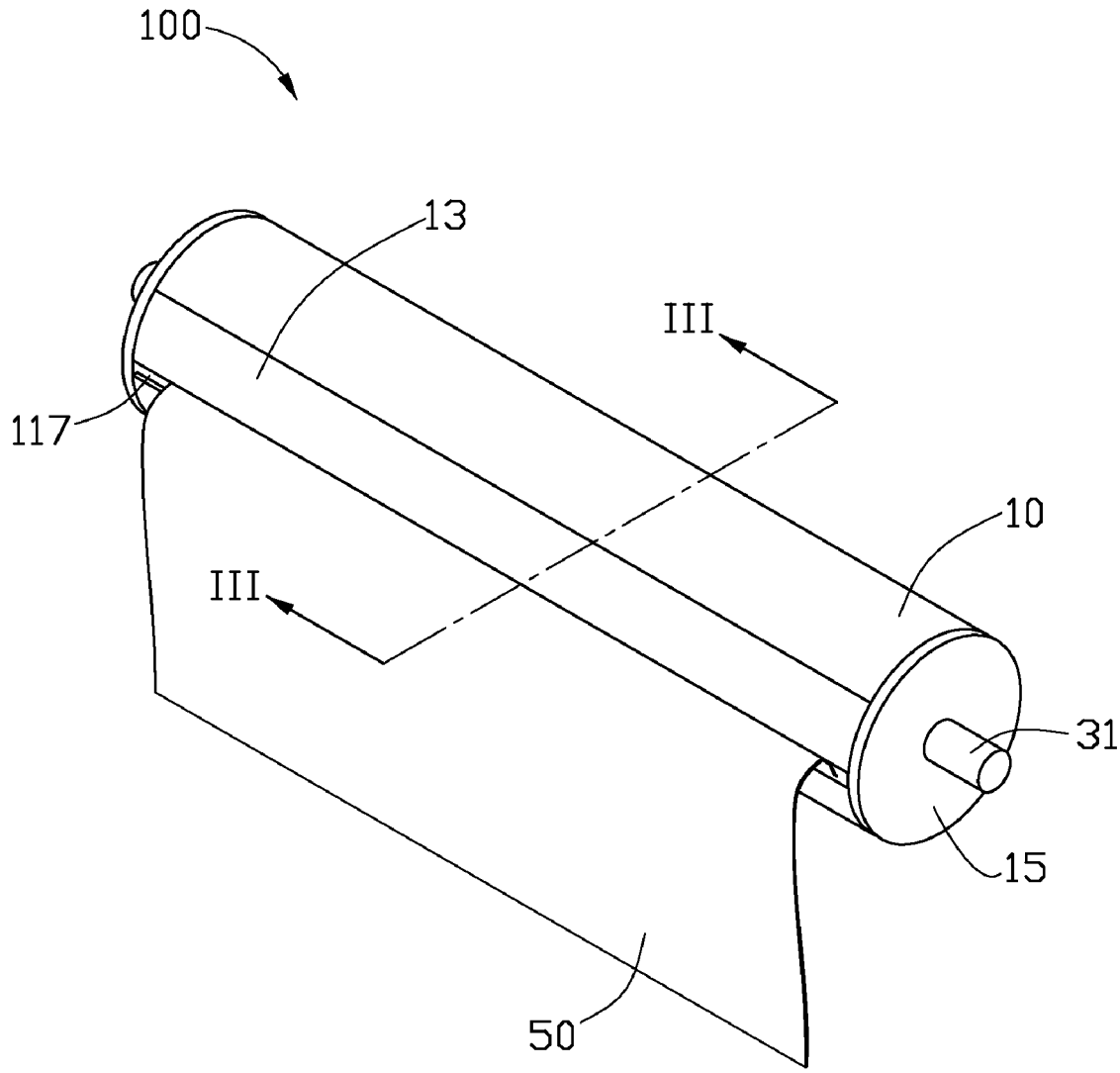
FIG. 1 is a schematic view of a banner displaying device according to an exemplary embodiment.
Figure 2:
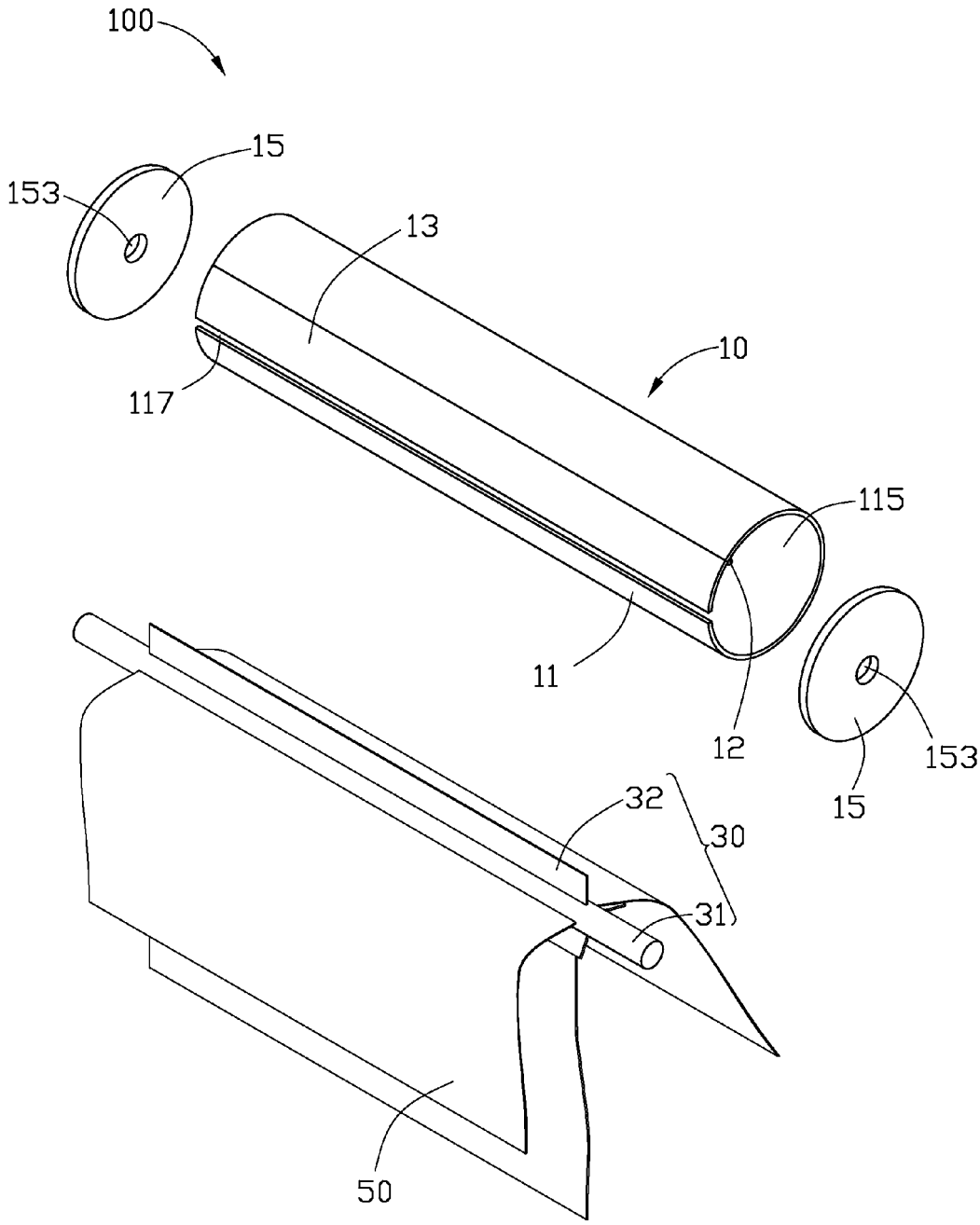
FIG. 2 is a disassembled view of the banner displaying device shown in FIG. 1.

Referring to FIG. 1 and FIG. 2, a banner displaying device 100 according to an exemplary embodiment is shown. The banner displaying device 100 includes a receiving member 10, a rotating member 30 rotatably mounted on the receiving member 10, and a plurality of banners 50 alternately fixed on the rotating member 30.

The receiving member 10 includes a main body 11, a hinge 12, a trapdoor 13, and two end-caps 15. The main body 11 may be a cylindrical barrel having two opened ends (not labeled). A cavity 115 is defined by the inner surface of main body 11. An opening 117 is defined in the sidewall of the main body 11, extends the length of main body 11 and communicates with the cavity 115.

A trapdoor 13 having a similar length to the opening 117 is provided. A height of the trapdoor 13 is less than that of the opening 117. The trapdoor 13 is received in the opening 117 and rotatably mounted on the main body 11 via the hinge 12. In this way, the trapdoor 13 can be rotated to reveal or partially cover the opening 117, leaving a gap (not labeled) between the distal edge of the trapdoor 13 and the main body 11.

The end-caps 15 are two boards, and each end-cap 15 has a round hole 153 defined in a central portion thereof. The two end-caps 15 are respectively mounted on two ends of the main body 11 to partially close the cavity 115.

The rotating member 30 includes an axle 31 and a plurality of partitions 32 radially mounted on the axle 31. While axle 31 may have any cross-sectional shape, the ends of the axle 31 are rounded and have a diameter approximately equal to that of the holes 153. Therefore axle 31 can be inserted into the two holes 153 and rotate therein. Each partition 32 has one edge connected to the axle 31 and one free edge. The height of each partition 32 is less than a radius of the cavity 115, so the rotating member 30 can be received into the cavity 115 without partitions 32 conflicting with the inner surface of main body 11. Furthermore, each partition 32 can also be wave-shaped and/or have irregularly shaped distal edges.

The banners 50 are made of soft and thin materials, such as paper or fabric and have for example, SOPs, printed thereon. Each banner 50 has an edge fixed to the axle 30, such as by glue, clamp or other means, and banner 50 can be folded to be received and stored between two adjacent partitions 32.

Figure 3:
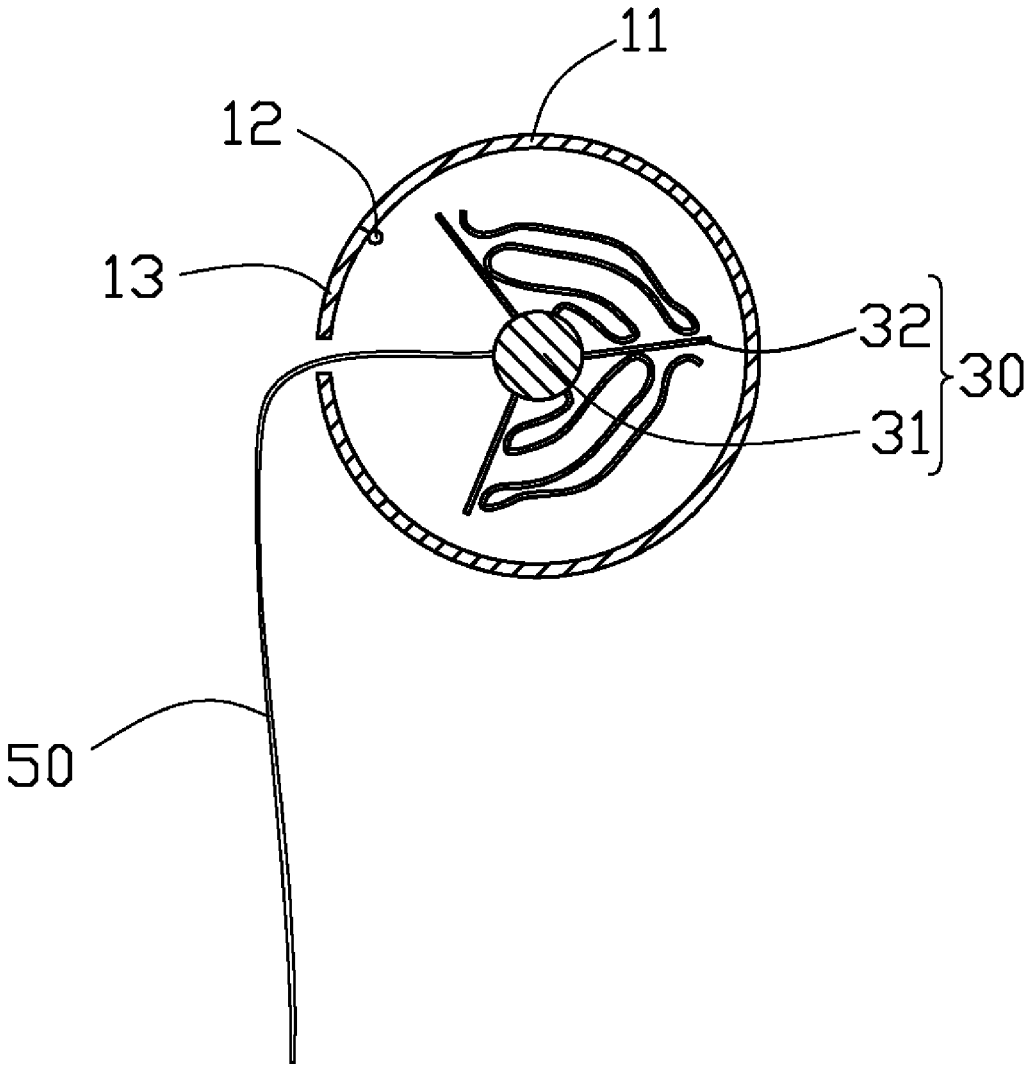
FIG. 3 is a radial cross-sectional view along the line III-III of the banner displaying device shown in FIG. 1.

Also referring to FIG. 3, in assembly, the trapdoor 13 is rotatably mounted to the main body 11 via the hinge 12. One end-cap 15 is mounted on an end of the main body 11 to cover the corresponding end of the cavity 115. Each banner 50 is folded and received between two adjacent partitions 32. The rotating member 30 with the banners 50 fixed thereon is then inserted into the cavity 115, and one end of the axle 30 extends out of the hole 153 of the end-cap 15 mounted on the main body 11. Another end-cap 15 is mounted on another end of the main body 11 to close the cavity 115, and the other end of the axle 31 extends out of the hole 153 of the end-cap 15 mounted on another end of the main body 11. In this way, the rotating member 30 is rotatably mounted on the receiving member 10, and the banners 50 are received in the receiving member 10.

When a banner 50 needs to be displayed, the axle 30 is rotated to align the banner 50 with the opening 117 of the receiving member 10. The axle 30 can be manually rotated, or automatically rotated by a driving apparatus such as a motor. The trapdoor 13 is opened, and the desired banner 50 is pulled out of the opening 117. The trapdoor 13 is then closed, and the banner 50 is exposed out of the aperture between the movable side of the trapdoor 13 and the main body 11 to be displayed. When the currently displayed banner 50 needs to be changed, the trapdoor 13 is opened again and the displayed banner 50 is folded and received into the cavity 115. The axle 30 is rotated to align a next desired banner 50 with the opening 117 for display.

Furthermore, the main body 11 and the trapdoor 13 can be made of transparent materials, such as glass or resin. In this way, the banners 50 received in the receiving member 10 can be easily viewed and selected. The main body 11 can also be configured to be in other shapes besides cylindrical.

The present banner displaying device 100 can be used to receive a plurality of banners 50 and selectively receive and/or display the banners 50. Therefore, the notices, such as SOP displayed on the banners 50, do not need to be removed from the banner displaying device 100. Thus, much work and time is saved. Additionally, the banners 50 received in the receiving member 10 are protected and can be re-used.

It is believed that the exemplary embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A banner displaying device, comprising:

a receiving member defining a cavity and an opening communicating with the cavity therein;

a rotating member rotatably mounted in the receiving member, the rotating member including an axle and a plurality of radially extending partitions mounted on the axle and received in the cavity; and a plurality of banners mounted on the axle, the banners and the partitions being alternately mounted on the axle; and wherein one of the banners at a time can be selectively pulled out of the opening.

2. A banner displaying device, comprising:

a receiving member defining a cavity and an opening communicating with the cavity, wherein the receiving member includes a cylindrical main body, the cavity being defined by at least one inner surface of the main body and the opening being defined in a wall of the main body; the receiving member also includes two end caps respectively mounted on two ends of the main body to partially close the cavity, and each end-cap defines a round hole therein; and a rotating member rotatably mounted in the receiving member, the rotating member including an axle and a plurality of radially extending partitions mounted on the axle and received in the cavity; and a plurality of banners mounted on the axle, the banners and the partitions being alternately mounted on the axle; and wherein one of the banners at a time can be selectively pulled out of the opening.

3. The banner displaying device as claimed in claim 2, wherein the receiving member includes a trapdoor rotatably mounted on the main body and partially closing the opening.

4. The banner displaying device as claimed in claim 1, wherein the receiving member includes two end-caps respectively mounted on two ends of the main body to partially close the cavity, and each end-cap defines a round hole therein.

5. The banner displaying device as claimed in claim 4, wherein the axle is inserted into the two holes to be parallel and rotatably mounted on the receiving member.

6. The banner displaying device as claimed in claim 1, wherein each partition has one edge connected to the axle.

7. The banner displaying device as claimed in claim 1, wherein each banner has an edge fixed to the axle and is received between two adjacent partitions.

8. A banner displaying device, comprising:

a receiving member defining a cavity and an opening communicating with the cavity, wherein the receiving member includes a cylindrical main body, the cavity being defined by at least one inner surface of the main body and the opening being defined in a wall of the main body; the receiving member also includes two end-caps respectively mounted on two ends of the main body to partially close the cavity, and each end-cap defines a round hole therein; and a rotating member rotatably mounted on the receiving member, the rotating member including an axle and a plurality of partitions mounted on the axle and received in the cavity.

9. The banner displaying device as claimed in claim 8, wherein the receiving member includes a trapdoor rotatably mounted on the main body and partially closing the opening.

10. The banner displaying device as claimed in claim 8, wherein the axle is inserted into the two round holes defined in the end-caps to be rotatably mounted on the receiving member.

11. The banner displaying device as claimed in claim 8, wherein each partition has one edge connected to the axle.

* * * * *